US009187894B2

(12) United States Patent
Zadok et al.

(10) Patent No.: US 9,187,894 B2
(45) Date of Patent: Nov. 17, 2015

(54) COLLAPSIBLE PORTABLE SHELTER UNIT

(75) Inventors: Yigal Zadok, Ft. Lauderdale, FL (US); Bryan Cole, Port Saint Lucie, FL (US); Jeffrey Strohecker, Parkland, FL (US)

(73) Assignee: Elite Aluminum Corporation, Coconut Creek, FL (US)

( * ) Notice: Subject to any disclaimer, the term of this patent is extended or adjusted under 35 U.S.C. 154(b) by 21 days.

(21) Appl. No.: 13/554,341

(22) Filed: Jul. 20, 2012

(65) Prior Publication Data

US 2013/0019913 A1 Jan. 24, 2013

(51) Int. Cl.
*E04H 15/48* (2006.01)
*E04B 1/344* (2006.01)
*E04H 1/00* (2006.01)

(52) U.S. Cl.
CPC ..... *E04B 1/3442* (2013.01); *E04H 1/005* (2013.01); *E04H 15/48* (2013.01)

(58) Field of Classification Search
CPC ..... E04H 1/005; E04H 1/00; E04H 15/48; E04H 15/02; E04H 15/18; E04H 15/30; E04B 1/343; E04B 1/344; E04B 1/3442; E04B 1/38; E04B 1/34321
USPC ..... 135/87, 88.17, 88.18, 91, 95, 97, 143, 135/148, 157–158, 116; 52/79.1, 79.5, 52/68–69, 143, 126.1, 288.1, 282.3, 282.5, 52/283, 582.1
See application file for complete search history.

(56) References Cited

U.S. PATENT DOCUMENTS 1,498,173 A * 6/1924 Kelley ..... 52/69
3,585,768 A * 6/1971 Klein ..... 52/282.4
3,818,662 A * 6/1974 DeSchutter ..... 52/282.3
4,633,626 A 1/1987 Freeman
4,667,580 A * 5/1987 Wetzel ..... 454/187
4,676,039 A * 6/1987 Leiter et al. ..... 52/282.4
5,345,730 A 9/1994 Jurgensen
5,461,832 A 10/1995 Smith
5,596,844 A * 1/1997 Kalinowski ..... 52/79.5
5,761,854 A 6/1998 Johnson
5,904,005 A * 5/1999 Dyer et al. ..... 52/71
5,966,956 A 10/1999 Morris
6,434,895 B1 8/2002 Hosterman
6,983,567 B2 1/2006 Ciotti
7,017,311 B2 * 3/2006 Weiss ..... 52/271
7,823,337 B2 * 11/2010 Pope ..... 52/67
7,841,136 B2 11/2010 Czyznikiewicz
8,286,391 B2 * 10/2012 Yang et al. ..... 52/69
8,555,559 B2 * 10/2013 DiGregory ..... 52/79.5
2003/0140573 A1 * 7/2003 Marcinkowski et al. ..... 52/79.5
2004/0194396 A1 * 10/2004 Shanni ..... 52/79.5
2005/0193643 A1 * 9/2005 Pettus ..... 52/79.1
2008/0236055 A1 * 10/2008 Laprise ..... 52/64

(Continued)

FOREIGN PATENT DOCUMENTS

EP 0127070 A3 12/1984
EP 1054113 A1 11/2000

*Primary Examiner* — Winnie Yip

(74) *Attorney, Agent, or Firm* — Robert C. Kain, Jr.

(57) ABSTRACT

A collapsible portable shelter unit when in the collapsed mode is light and compact to make transport and storage convenient, but when opened provides an enclosed space that can be used for various purposes, which has an integrated high strength structured frame by the action of the interlocking extrusions which also provide resistance to water and wind infiltration. As needed, exterior windows and doors, air conditioning, electrical supply and other customization as required by the users' needs.

11 Claims, 13 Drawing Sheets

(56) References Cited

U.S. PATENT DOCUMENTS

2009/0044460 A1 2/2009 Medley
2009/0217600 A1 9/2009 DeAzambuja
2010/0050540 A1* 3/2010 Bucher et al. ..... 52/67
2010/0050556 A1* 3/2010 Burns ..... 52/592.1

* cited by examiner

COLLAPSIBLE PORTABLE SHELTER UNIT

RELATED APPLICATIONS

This application claims priority based upon U.S. Provisional Patent Application Ser. No. 61/510,564 filed Jul. 22, 2011.

FIELD OF THE INVENTION

This invention relates to a collapsible portable habitable shelter structure. More particularly, the present invention relates to a structure that collapses into a small, compact configuration that is light, easily stored, easily transported, and can be folded out to become a structurally habitable shelter.

BACKGROUND OF THE INVENTION

Emergency type housing units have been desired for numerous applications. Typically the units are nothing more than steel shipping containers which are modified for the usage desired. They tend to be heavy, difficult to transport, provide very limited functional space, and not desirable as a living area. Increasing of the functional space has been crudely addressed by cutting out portions of the container and affixing multiple containers together. The appearance of the units has remained to be that of a shipping container or trailer, usually with the need to perform extensive work on the interior to make the unit functional. Further, a single unit typically does not supply sufficient space to accomplish the needed function as the containers are so narrow in width that two or more containers must be placed together to get a functional space. When multiple units are assembled, the need to prevent water and wind infiltration causes considerable additional work to be done by skilled craftsmen, with specialty products to seal the units and properly connect them, which materials are not always available.

Since the steel units are bulky, heavy in weight, difficult to store and transport is typically handling one unit at a time, with a crane needed to move the units. These difficulties restrict the usage and desirability of container type units.

The challenge and need was for a unit that was light weight and compact when not in use so that it may be efficiently stored and transported, that supplies an attractive, functional space, that is strong, water and wind resistant, as well as adaptable to weather conditions, adaptable easily to special needs, and could be installed without special supplies or skilled labor in minimal time periods.

DISCLOSURE OF THE INVENTION

The present invention is a transformable collapsible structure or unit with a rigid center core structure with a top portion, a base portion, a first and second end section, affixed to a welded aluminum extrusion frame structure, to which is connected multiple sections, being a first and a second roof section, a first and a second floor section, a first and a second exterior wall section, and multiple side wall sections. The sections fold out to form an enclosed space adjoining the center core structure on side creating a useable and habitable interior space. The structure is unexpectedly strong and resistant to wind and water infiltration by use of metal extrusions caps at all folding joints which are continuous and interlocking, thereby stopping water or wind infiltration. The points of connection between wall sections where a rotating joint is not needed use a metal extrusion with tongue and groove configuration being tight fitting and which provides structural strength and resistance to both water and wind infiltration.

The structure or unit is stored in a folded configuration and can be put into use by first leveling the closed unit, placing floor support beams, rotating the roof sections upward to allow the floor and wall sections to be rotated downward, resting the floor section on the floor beams, rotating the exterior wall sections vertical and connecting the roof section to the exterior wall section. The side wall sections are then swung out to connect to the roof section and exterior wall sections.

When the roof section, floor section, exterior wall section and side wall section are rotated into position, the continuous extended metal caps lock the extrusions together providing structural strength and resistance to wind and water infiltration.

The connections between the wall sections where the sections do not have a rotation joint have a continuous extruded metal cap which is of a tongue and groove type connection, between mating edges providing structural strength and resistance to water and air infiltration.

BRIEF DESCRIPTION OF THE DRAWINGS

To further describe and obtain a fuller understanding of the nature and objectives of the invention, the accompanying drawings are provided in which like parts are given reference numerals.

DETAILED DESCRIPTION OF THE INVENTION

Figure 1:
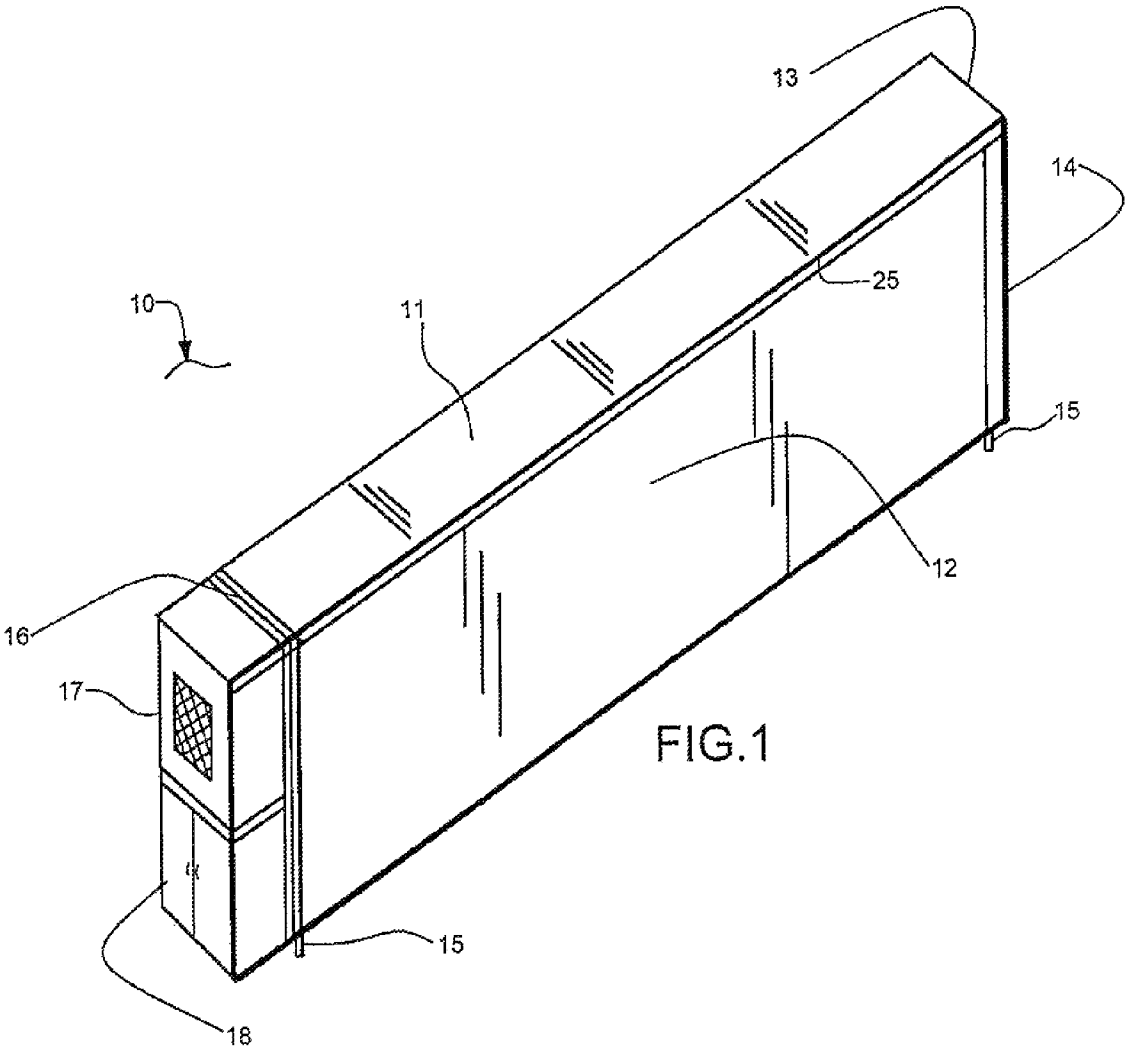
FIG. 1 is a prespective of the collapsible portable shelter unit in a closed configuration for storage or transport.

Referencing FIG. 1 is a transformable rectangular collapsible portable unit in the collapsed state being one embodiment of the present invention, which forms a modular unit 10 which is approximately 30 inches in width at edge 16 with a length of approximately 18 feet at edge 19, with height approximately 8 feet at edge 14 allowing three units to be placed side by side in a typical shipping container or tractor trailer. Different dimensions can be used to meet the intended need for the unit.

The modular unit 10 has a rigid central core frame 19, composed of aluminum extrusions. The frame, FIG. 3, has horizontal 56 and vertical 27 extrusions welded together to form a rectangle and two such rectangles are welded together with cross beam 28 extrusions. The result is a box beam frame that has greater strength than expected. With the attachment of base portion 26, roof portion 25, and the end sections 20, 13, the core provides support for the roof sections 25, floor sections 22, exterior wall sections 21, and side wall sections 24, that are adhered to the core and fold out to form an interior space. At the end of the core, FIG. 1, attached is an air conditioning unit 17, which can provide both cooled or heated air to the interior space. An electrical storage cabinet 18 is also provided for any needed electrical equipment for power distribution. At the other end of the core, in other configurations a storage cabinet can be affixed. In this closed configuration, FIG. 1, the unit 10 can be easily transported by a lift or wheeled with installation of wheels at each corner of the base portion.

Figure 2:
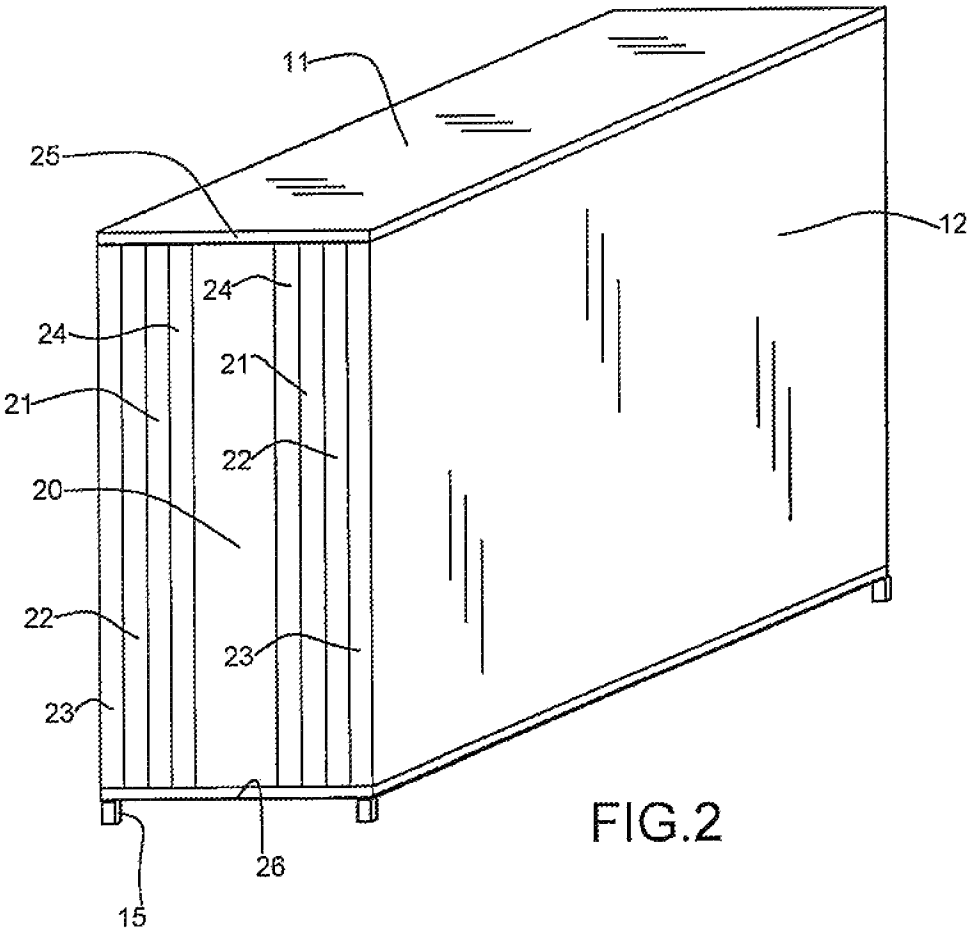
FIG. 2 is a prespective showing the end of a collapsed unit without the end utility sections or cover in place.

FIG. 2 shows the exposed end of the modular unit. The central core end portion 20 is shown and adjacent to it, on each side, are multiple panels which fold out to transform the modular unit into an expanded useable shelter. The most exterior panel 23 is the extending roof sections, followed by the floor sections 22, and then the exterior wall sections 21. The inner most section is the side wall sections 24. The roof 23, floor 22, exterior wall 21 and side wall 24 sections can rotate out to locking positions to create an interior space. The roof, floor, exterior wall and side wall sections are composite panels.

Figure 3:
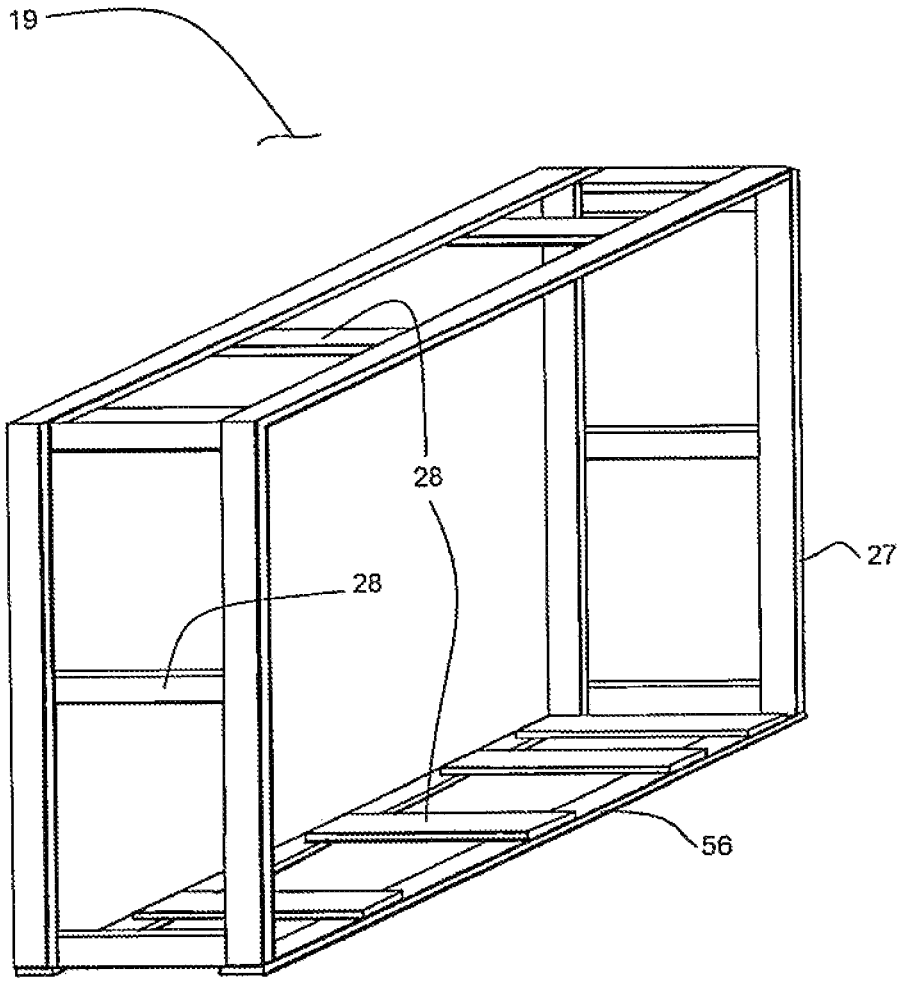
FIG. 3 shows the frame structure of the center core section of the collapsible unit.

The preferred center core section FIG. 3 is a rigid frame of extruded aluminum vertical beams 27 welded together with horizontal extruded aluminum beams 28, to create a box beam structure which provides high strength but is light in weight. However, the rigid frame can be configured in various shapes known in the art to provide rigid structures.

Figure 4:
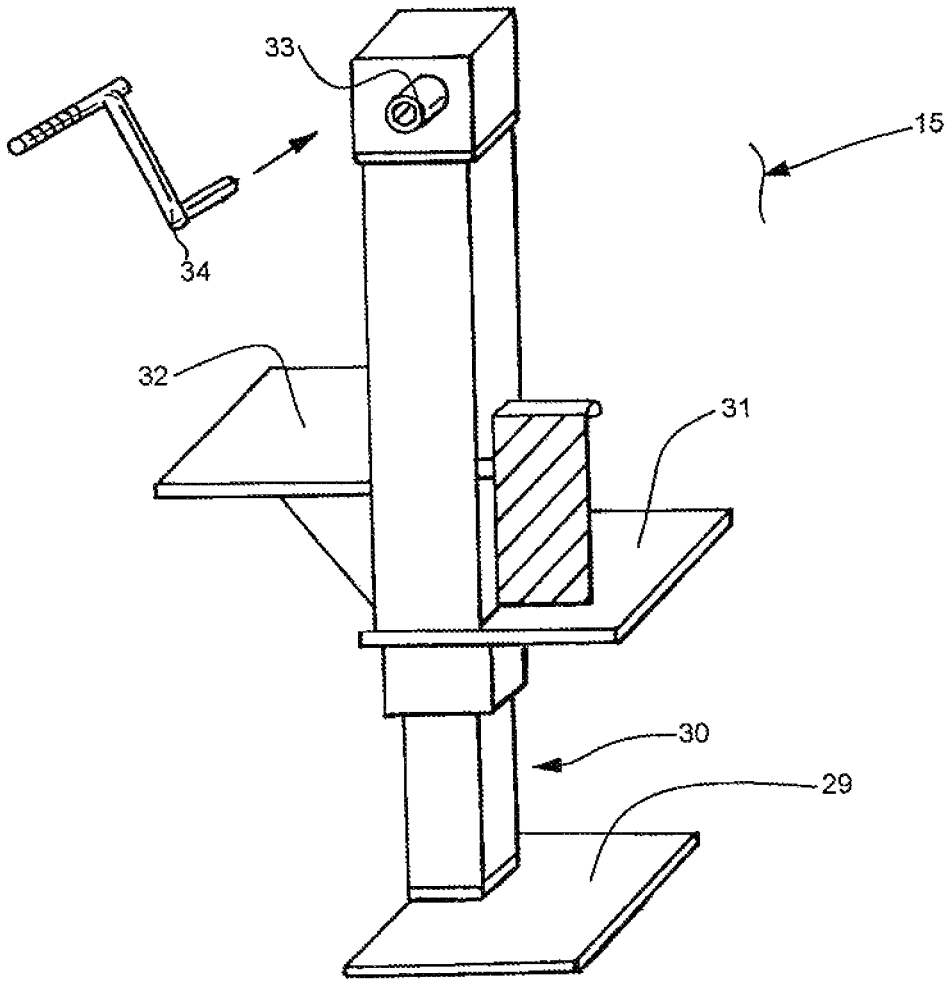
FIG. 4 shows the support and leveling unit at the corners of the center core section.

FIG. 1 shows supports 15 at each of the corners of the modular unit 10. FIG. 4 shows the configuration of the support 15, in detail. It consists of a base plate 29 a supporting leg 30, supporting plates 32 and 31 to hold the core structure with a wrench 34 that can be inserted into the socket 33 to allow ratcheting or cranking of the supporting leg 30 to allow height and leveling adjustment of the modular unit both quickly and easily. Although this is the preferred embodiment numerous other known mechanisms can be used such as a multi-holed support through which a bolt is passed through to set heights at various discrete settings, or plates with threaded rods connected thereto which can be adjusted by rotating the threaded rod to adjust height.

Figure 5:
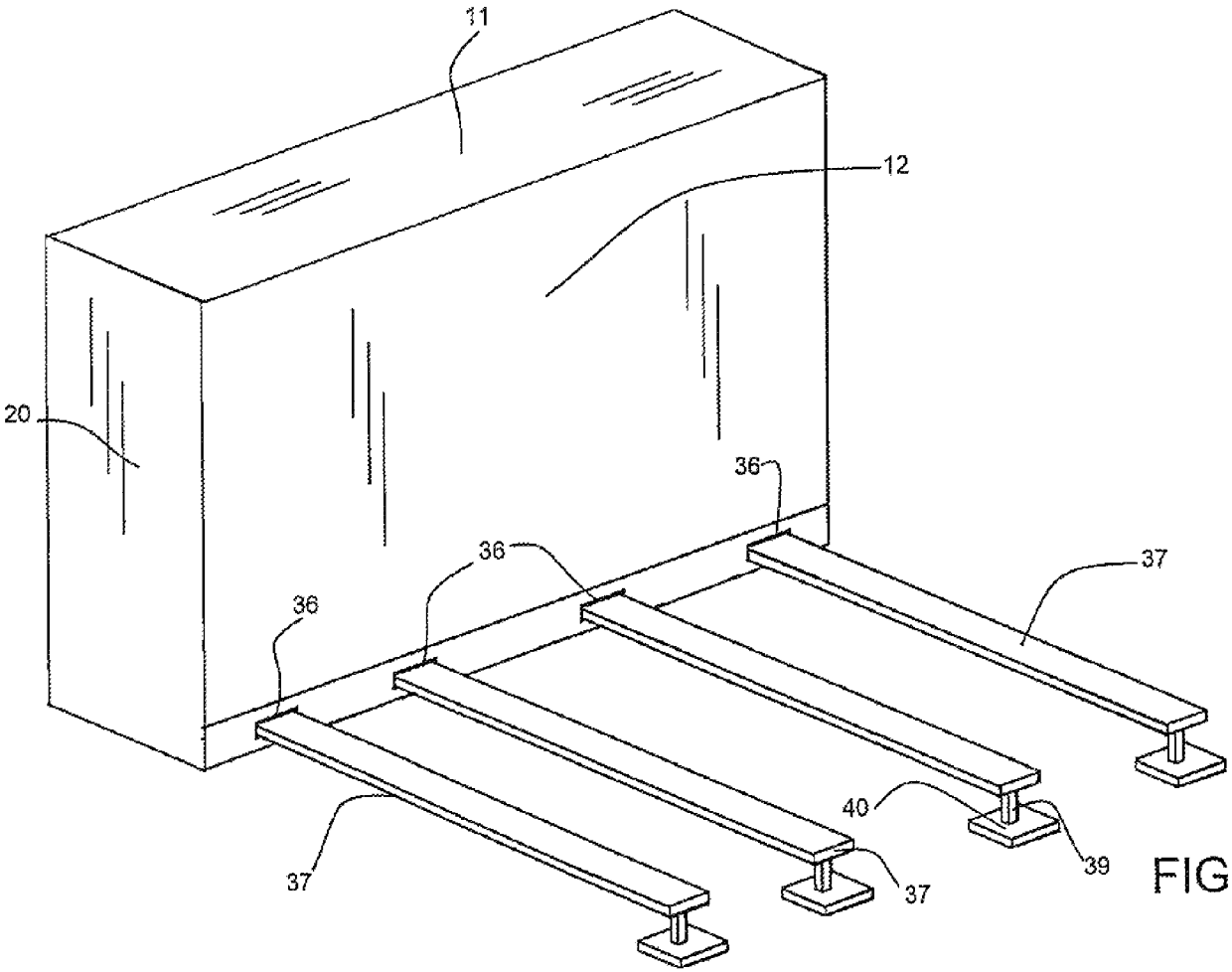
FIG. 5 is a prespective of the unit with the floor support beams being put into place.

When it is desired to employ the modular unit, the unit 10 is placed in a cleared area. This can be on stabilized ground, or any reinforced base such as gravel, concrete or asphalt, and the unit 10 is leveled using the supports 15, to set the correct height and all corners are leveled. Support beams 37 are inserted as shown in FIG. 5 in receptacles 36 located along the base portion of the modular unit. At the other end of the beams 37 are plates with welded threaded rods which thread into the end of the beam 37. The plate 40 is rotated until all the beams 37 are level and thereby perpendicular with the exterior wall surface 12 of the unit 10.

Figure 6:
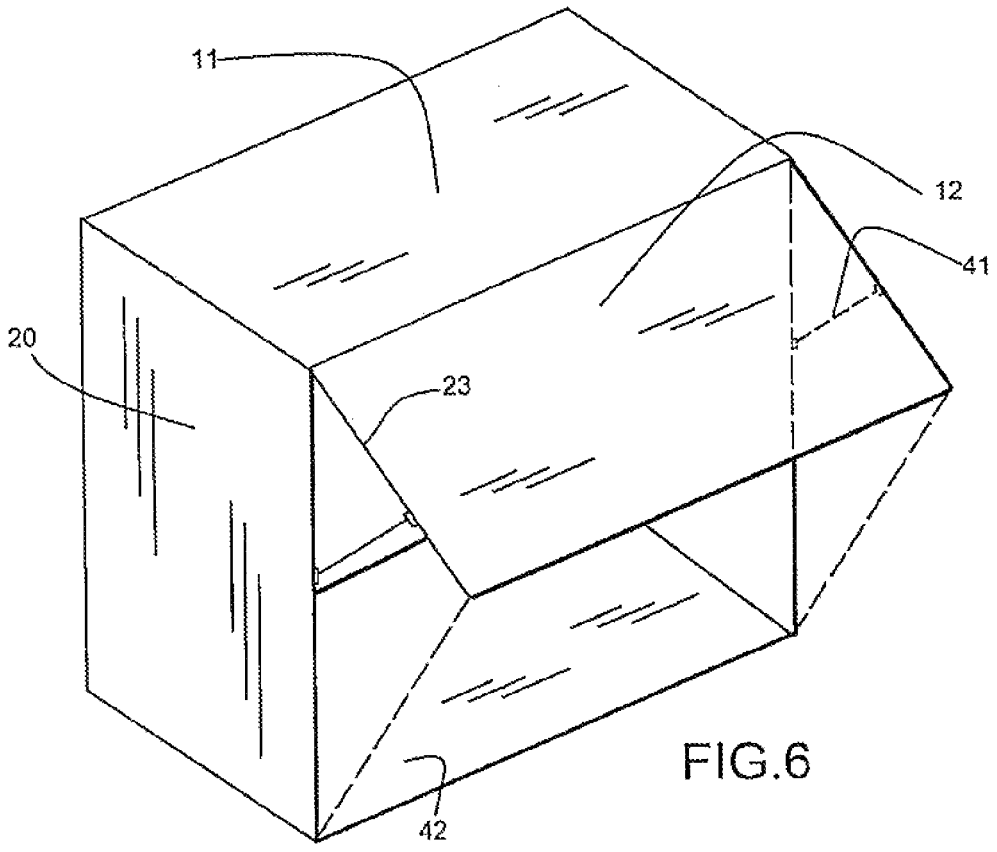
FIG. 6 shows the motion of opening of the unit by rotating of the roof section.

FIG. 6 shows the modular unit 10 being opened. The exterior roof panel section 23 is rotated out approximately 90 degrees, away from the unit body. Two spring-loaded dampers 41 as shown in FIG. 6 assist in providing support to the roof section 23. The exterior portion of the top of the core section 11 and the exterior surface 12 of the roof section 23 are preferably covered with a roofing material or other material, depending upon the use of the unit.

Figure 7:
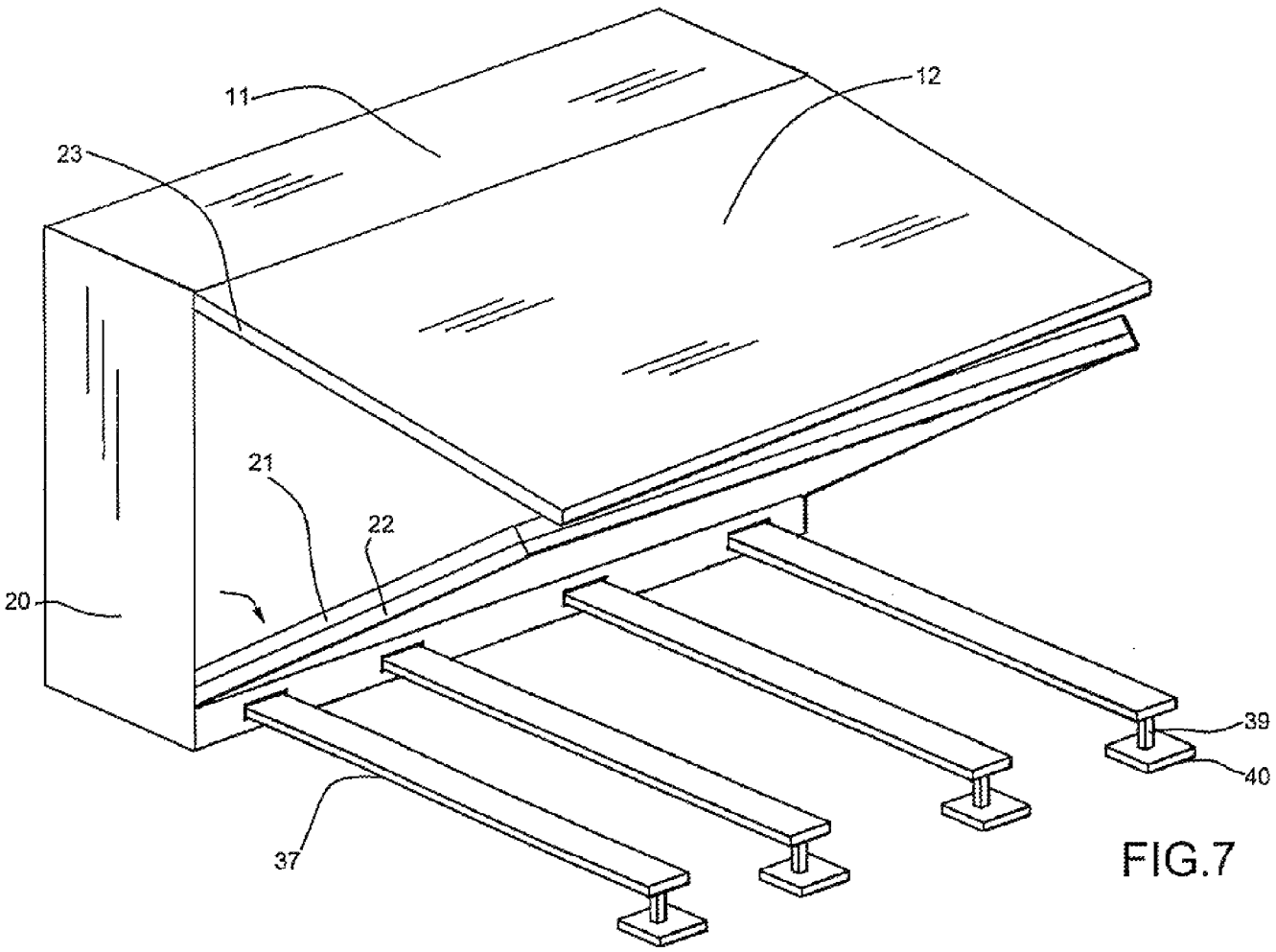
FIG. 7 shows the floor section being rotated into place.
Figure 9:
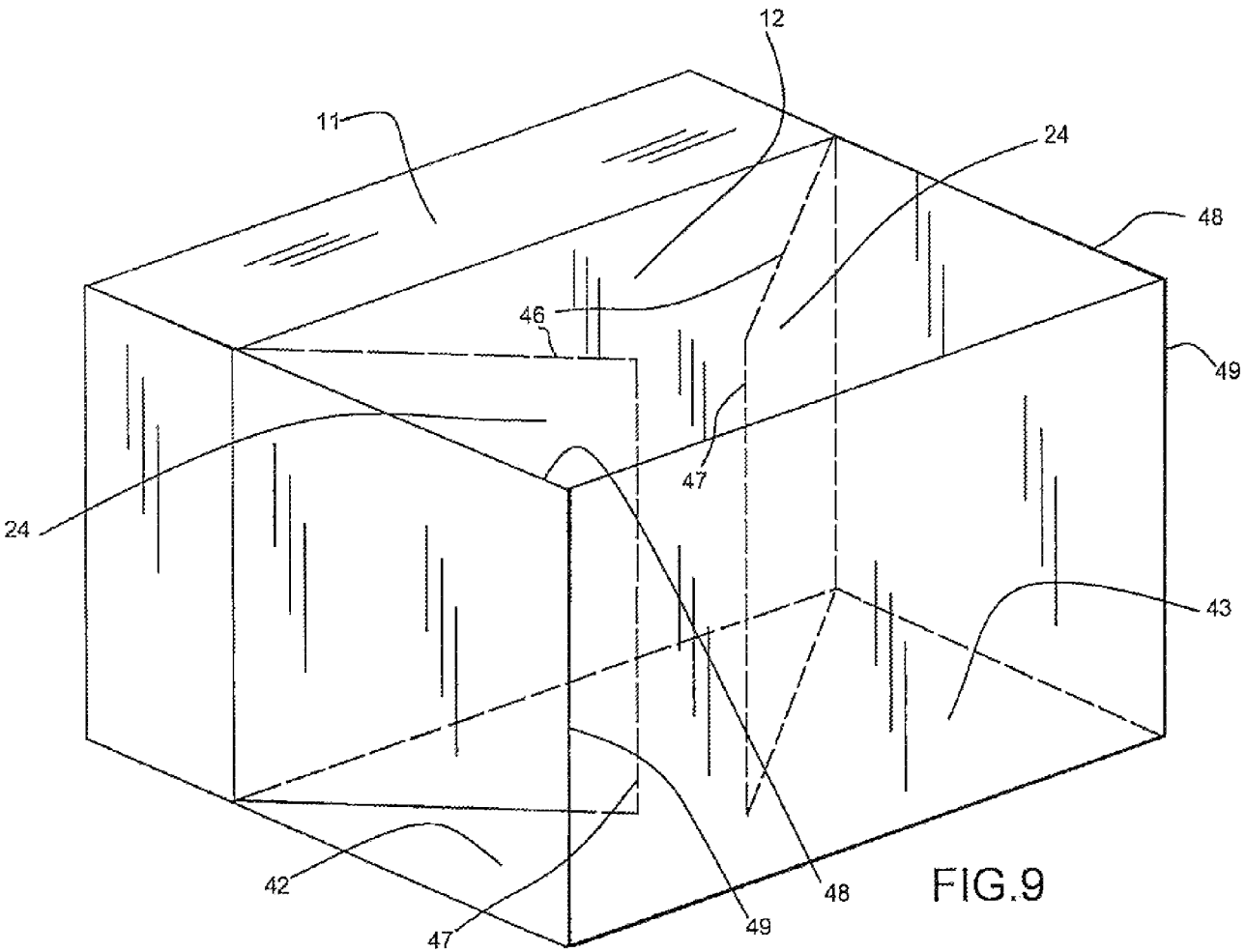
FIG. 9 shows the motion of the side walls being rotated outward to interlock with the roof and exterior wall sections.

FIG. 7 shows the continued opening of the roof section 23 which allows the combined floor 22 and exterior wall 21 sections to be rotated outward to a resting position upon the supporting floor beams 37. With the floor section 22 put into place the exterior wall section 21 is rotated vertically and the upper edge 61 interlocks with the exterior edge 62 of the roof section 23. The detail of the interconnection of edges 61 and 62 is seen in FIG. 12*b*. Additional interlocking can be accomplished with conventional locking mechanisms located along the exterior wall edge. With the roof edge 62 affixed to the exterior wall edge 61, the side walls 24 can be folded out as shown in FIG. 9, the edges 46 and 47 of which connect with the roof edge 48 and exterior wall edge 49.

Figure 8:
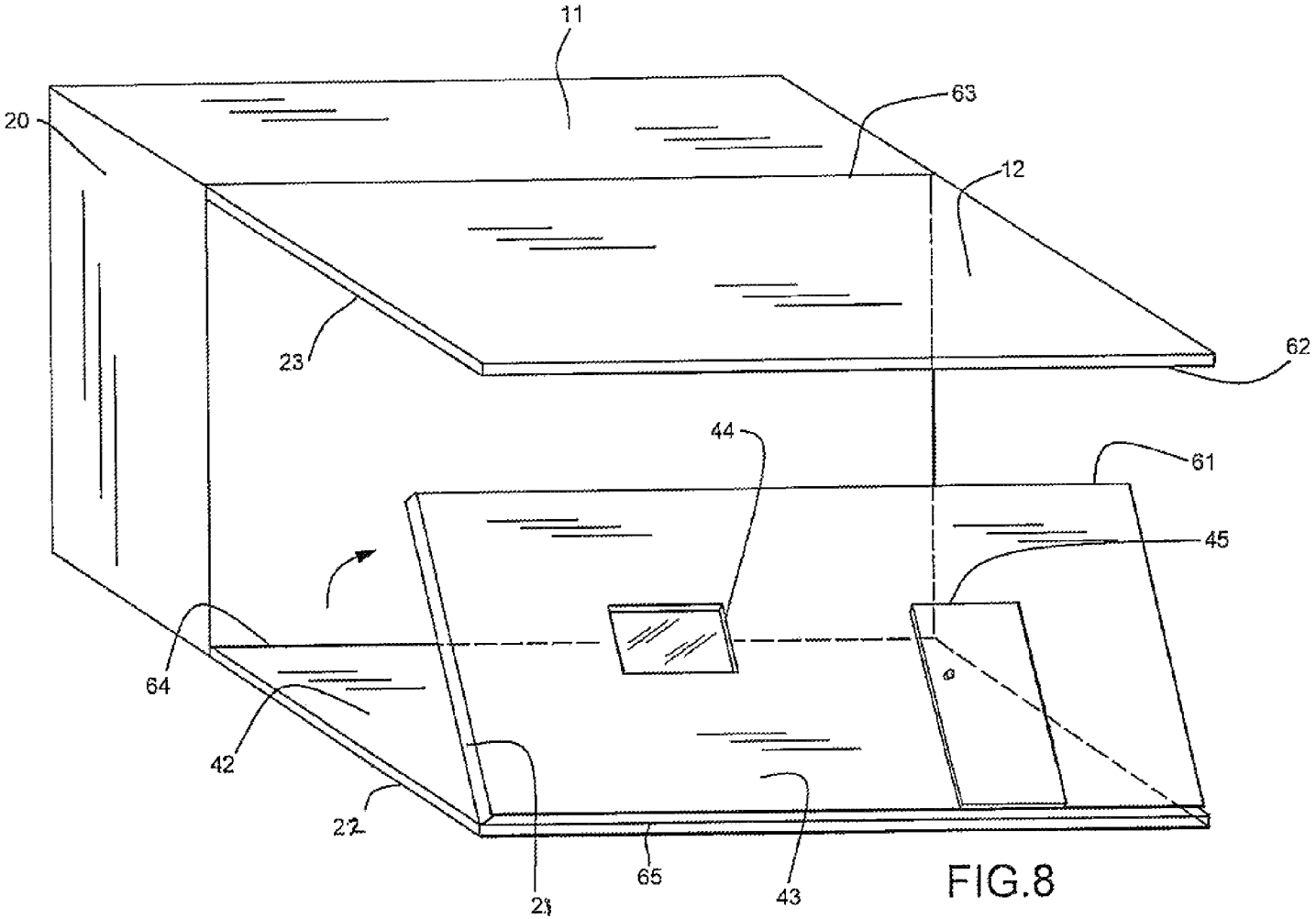
FIG. 8 shows the exterior wall section being rotated into an upright position.
Figure 10:
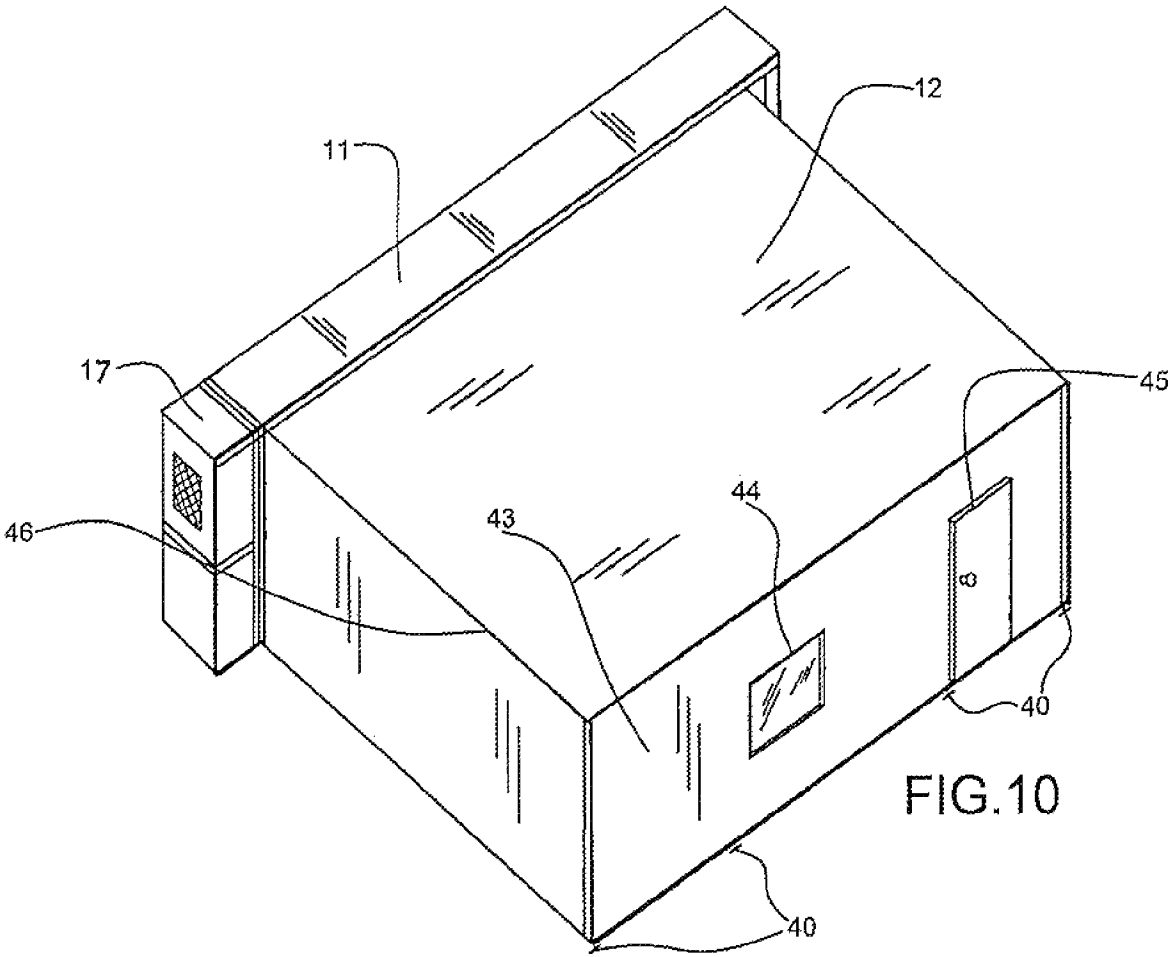
FIG. 10 shows a prespective of the unit with one side opened and locked into place.
Figure 11:
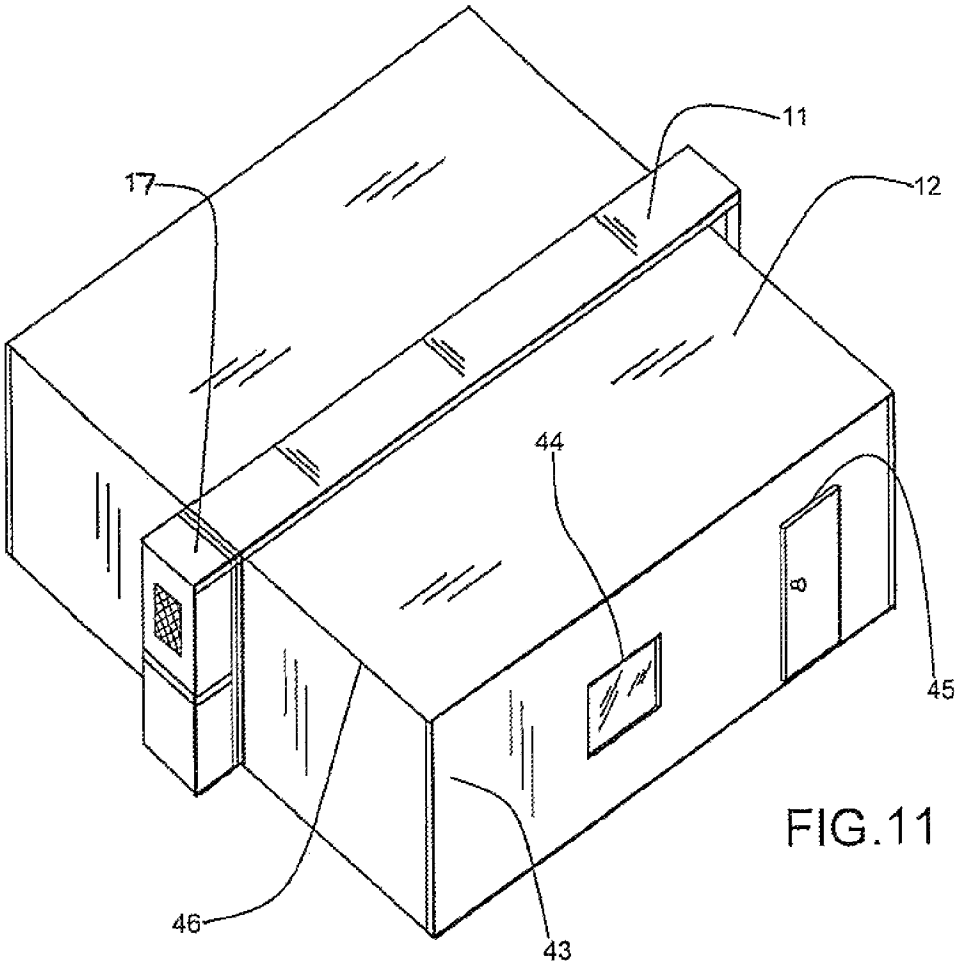
FIG. 11 shows a prespective of the unit with both sides opened.

FIG. 10 shows the expanded configuration of one side of the modular unit 10, and in FIG. 11 the modular unit has been completely opened. The roof, exterior wall and side wall sections are insulated composite panels comprised of an exterior panel, being a lightweight rust free material, a center core of a thermal resistant material, and an interior panel, all adhered together. In the preferred configuration the interior and exterior panels are aluminum with an interior core of expanded polystyrene foam or a polyurethane foam. The use of insulated panels provides temperature stability and the center core section, with the air conditioning/ventilation unit 17 provide both cooling and heating directly into the habitable interior space. The edges of the panels are capped with metal extrusions which provide the connecting functions between panel edges, either a rotating hinged connection as seen at connections 64 between base portion and floor section, or top portion and roof section 63, or floor and exterior wall section 65 as shown in FIG. 8, or an interlocking between roof section edge 62 and exterior wall section edge 61 as seen in FIG. 8.

Figure 12A:
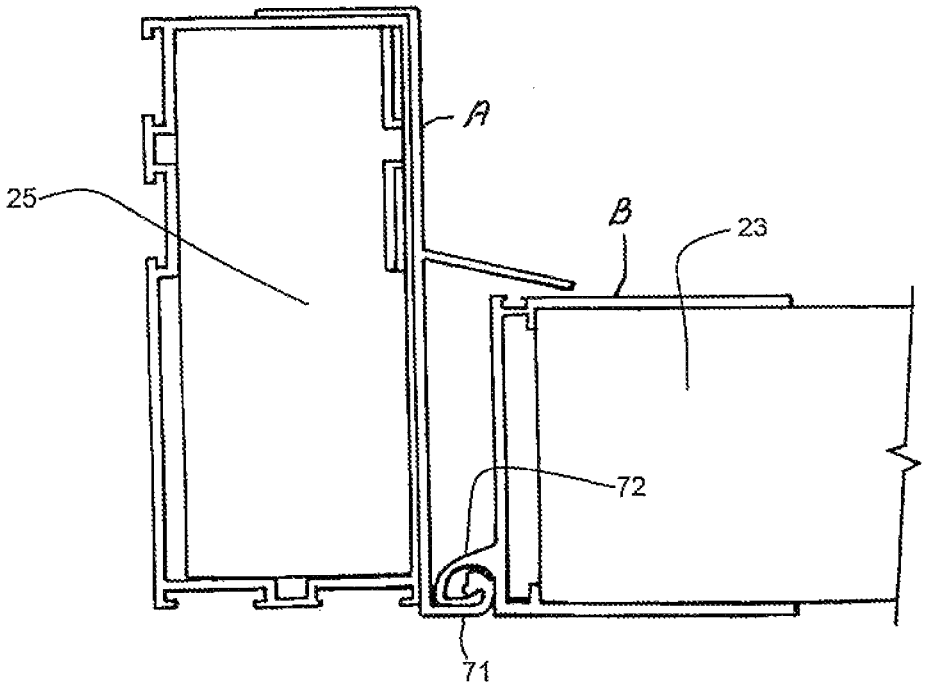
FIG. 12*a* shows a detail of the interconnection for a rotating joint.
Figure 12B:
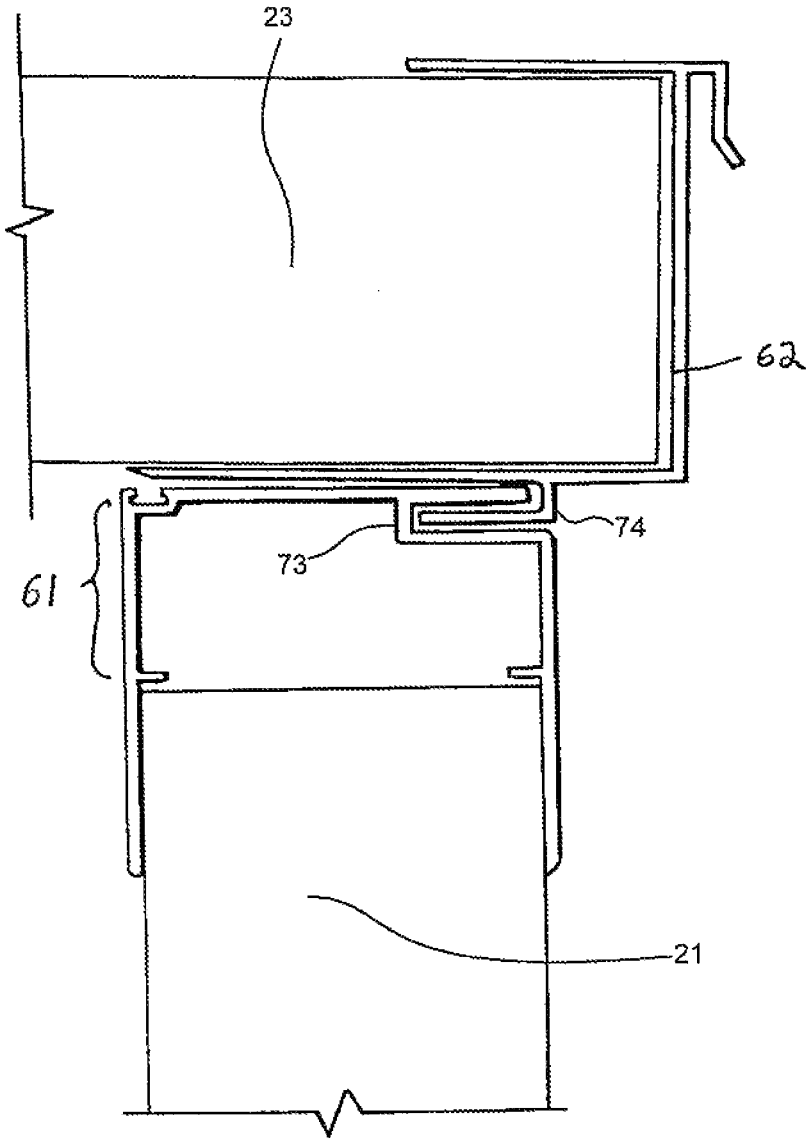
FIG. 12*b* shows a detail of the edge interlock.

FIG. 12*a* shows typical rotating connection wherein a top roof portion cross-section 25 and roof section cross-section 23 are connected by an extrusion intersection with cross-section of the components. The two metal extrusion caps A, B interlock by rotating about each other in a circular mating of a portion of the extrusion 71 of the roof top cap with a portion of the extrusion 72 of the roof section cap, locking the extrusions together creating a seal between extrusions. As shown in FIG. 12*a*, top roof portion extrusion 71 is C-shaped interface with an upwardly disposed open C-mouth and roof section extrusion 72 is a complementary C-shaped interface with a downwardly disposed C-mouth. Both extrusions mate and interlock with downward C-shaped extrusion 72 overlaid into the upward C-shaped extrusion 71 when the roof portion and roof section are generally aligned together (after rotation of the section with respect to the portion; see FIG. 6). The result is a locking of the extrusions and panels to create a structure stronger than expected. Further, the connection stops water and wind infiltration through the joint.

In other configurations, at the tongue and groove connection, a sealant may be placed at the exterior of the connection to prevent water or wind infiltration. Preferably if sealant is used it should be placed after the connection between the sections are made to allow easier removal of the sealant when dissembling the unit.

FIG. 12*b* shows the interlock connection used between the roof section 25 outer edge 62 and the upper edge 61 of the exterior wall 21, which may also be used by the side wall section connecting with the exterior wall section or with the roof section edge. This tongue 74 and groove 73 connection interlock is a substantially continuous contact that provides a structural integrity for the frame of the opened structure that is stronger than expected. Further, the tongue and groove connection prevents water and air infiltration.

In the configuration shown in FIGS. 8, 10 and 11, one or more windows 44 or doors 45 can be provided in the exterior walls section or side walls sections, as well as pre-wiring the walls and interior core for electric, data, and plumbing services. In other configurations, the modular unit may have interior partitions installed at a later time, to be adjusted as the use of the unit requires. Kitchenette modules and bathroom modules can be added to the unit if those functions are desired.

Since the modular unit contains all needed components pre-installed, a minimally trained crew of two men can level and fully expand a modular unit, having it operational in 15 to 30 minutes, depending on the skill and experience of the crew.

In other configurations, the modular units have wheels located at each end of the rigid central core section which allows the units to be conveniently wheeled to and from storage to truck loading dock without special equipment or moved at the desired location prior to opening. While various exemplary aspects and embodiments have been shown or discussed herein, other modifications that may be employed are within the scope of the invention. Accordingly, the present invention is not limited to the configuration shown, and is intended to embrace all such attention modifications or variations that fall within the spirit and scope of the appended claims.

Furthermore, to the extent that the term "includes" is used in either the detailed description or the claims, such term is intended to be inclusive in a manner similar to the term "comprising" as "comprising" is interpreted when employed as a traditional word in a claim.

What is claimed:

1. A transportable collapsible structure, said structure comprising a rigid rectangular core comprising, a base portion, a top portion, a first and a second end section affixed to a rigid welded aluminum extrusion frame structure with the end sections affixed to the opposite ends of the base portion and top portion, a collapsible rectangular container portion integral with the rigid rectangular core comprising, a first and a second roof section, a first and a second floor section, a first and a second exterior wall section, a first and a second side wall section, which are connected to each other or to the core, which allows the sections to fold out to form an enclosed space adjacent to the core, a plurality of section caps of extruded metal sections which are affixed to the elongated edges of and are the approximate elongated edge length of the roof, floor, exterior wall and side wall sections to which they are attached which is where the sections and/or core are adjoining to each other, wherein the extruded metal caps mate with each other such as to be in continuous contact via complementary C-shaped interfaces, allowing rotating motion of the connected sections of approximately ninety degrees between two adjoining sections or core with a section, when adjoining sections are rotated the two extrusions rotate about each other locking together creating a seal by overlaying C-shaped interfaces together between extrusions, a plurality of caps of extruded metal sections which are affixed on the elongated edges of and are the approximate elongated edge length of the roof, floor, exterior wall and side sections to which they are attached, which is where the sections are not rotatingly connected to each other, wherein the extruded metal caps mate with each other in a tongue and groove connection such as to be in substantially continuous contact and attached together, a plurality of floor support beams with leveling plate at one end the opposing end fitting into a slot in the base portion of the core, means for leveling the core at each corner of the base portion, wherein the core can be leveled, the floor beams placed and leveled, the roof section being rotated upward to allow the floor section and exterior wall section to be rotated downward such that the floor section rests on the floor beam, the exterior wall section being rotated perpendicular to the floor section such that the outer edge of the exterior wall section connects with the outer edge of the roof section, the side wall section being rotated outward so that the side wall sections connect with the roof and outer wall sections, thereby creating an enclosed useable space.

2. The transportable collapsible structure of claim 1, wherein the metal extrusions are made from aluminum.

3. The transportable collapsible structure of claim 1 wherein the floor, roof, exterior wall and side wall sections are comprised of an interior panel, an exterior panel and an interior insulating material adhered together.

4. The transportable collapsible structure of claim 1, wherein the exterior wall section contains at least one opening.

5. The transportable collapsible structure of claim 1, wherein the side wall section contains at least one opening.

6. The transportable collapsible structure of claim 1, wherein an adjustable sup port integrally part of the base is located at each corner of the base portion.

7. The transportable collapsible structure of claim 6, wherein the adjustable support is adjusted by use of a cranking mechanism.

8. The transportable collapsible structure of claim 1, wherein wheels are attached under the base portion.

9. The transportable collapsible structure of claim 1 wherein the roof sections are assisted in support by spring loaded dampers.

10. The transportable collapsible structure of claim 1 wherein an air conditioning unit supplying cooling or heating is affixed to the core.

11. The transportable collapsible structure of claim 1 wherein an electrical panel unit for supplying electrical current to the interior of the structure is affixed to the core.

* * * * *